US010910130B2

(12) United States Patent
Kubota et al.

(10) Patent No.: US 10,910,130 B2
(45) Date of Patent: Feb. 2, 2021

(54) CORROSION-RESISTANT TERMINAL MATERIAL, CORROSION-RESISTANT TERMINAL, AND WIRE-END STRUCTURE

(71) Applicant: MITSUBISHI MATERIALS CORPORATION, Tokyo (JP)

(72) Inventors: Kenji Kubota, Naka (JP); Yoshie Tarutani, Naka (JP); Kiyotaka Nakaya, Naka (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days.

(21) Appl. No.: 16/488,288

(22) PCT Filed: Mar. 6, 2018

(86) PCT No.: PCT/JP2018/008591
§ 371 (c)(1),
(2) Date: Aug. 23, 2019

(87) PCT Pub. No.: WO2018/164127
PCT Pub. Date: Sep. 13, 2018

(65) Prior Publication Data

US 2020/0005963 A1 Jan. 2, 2020

(30) Foreign Application Priority Data

Mar. 7, 2017 (JP) ..... 2017-042713
Mar. 7, 2017 (JP) ..... 2017-042714

(51) Int. Cl.
*H01B 7/28* (2006.01)
*C25D 5/12* (2006.01)
(Continued)

(52) U.S. Cl.
CPC ..... *H01B 7/2806* (2013.01); *C25D 5/12* (2013.01); *C25D 7/0607* (2013.01); *H01R 4/18* (2013.01); *H01R 4/62* (2013.01); *H01R 13/03* (2013.01)

(58) Field of Classification Search
CPC ... H01R 4/02; H01R 4/04; H01R 4/18; H01R 4/62; H01R 13/03
(Continued)

(56) References Cited

U.S. PATENT DOCUMENTS

2011/0225820 A1* 9/2011 Kondo ..... H01R 43/048 29/863
2012/0325552 A1 12/2012 Sakura
(Continued)

FOREIGN PATENT DOCUMENTS

EP 2224556 A1 9/2010
JP 2004-134212 A 4/2004
(Continued)

OTHER PUBLICATIONS

International Search Report dated May 22, 2018, issued for PCT/JP2018/008591.
(Continued)

*Primary Examiner* — William H. Mayo, III
(74) *Attorney, Agent, or Firm* — Locke Lord LLP

(57) ABSTRACT

A corrosion-resistant terminal material has a substrate made of copper or a copper alloy and a film layered on the substrate. The film has a planned core wire contact part with which a core wire of an electric wire is in contact when the material is formed to a terminal and a planned contact part. The film formed in the planned core wire contact part has a tin layer made of tin or tin alloy and a metallic zinc layer formed on the tin layer; the film formed in the planned contact part has a tin layer made of tin or tin alloy but does
(Continued)

not have a metallic zinc layer. A corrosion-resistant terminal uses the corrosion-resistant terminal material described herein.

12 Claims, 6 Drawing Sheets

(51) Int. Cl.

| | |
|---|---|
| ***C25D 7/06*** | (2006.01) |
| ***H01R 4/18*** | (2006.01) |
| ***H01R 4/62*** | (2006.01) |
| ***H01R 13/03*** | (2006.01) |

(58) Field of Classification Search
USPC ..... 174/74 R, 75, 76, 77 R, 78, 84 R, 88 R
See application file for complete search history.

(56) References Cited

U.S. PATENT DOCUMENTS

| | | | | |
|---|---|---|---|---|
| 2014/0162505 | A1* | 6/2014 | Ohnuma | H01R 4/62 439/877 |
| 2016/0336662 | A1* | 11/2016 | Ooba | H01R 4/029 |
| 2017/0117650 | A1* | 4/2017 | Yoshida | C10M 141/10 |

FOREIGN PATENT DOCUMENTS

| | | | | | |
|---|---|---|---|---|---|
| JP | 2008-248332 | A | | 10/2008 | |
| JP | 2009-152052 | A | | 7/2009 | |
| JP | 2011-165618 | A | | 8/2011 | |
| JP | 2011-222243 | A | | 11/2011 | |
| JP | 2013-33656 | A | | 2/2013 | |
| JP | 2015-141784 | A | | 8/2015 | |
| JP | 2015-162374 | A | | 9/2015 | |
| JP | 2016-166397 | A | | 9/2016 | |
| JP | 2016-169439 | A | * | 9/2016 | H01B 5/02 |

OTHER PUBLICATIONS

Supplementary European Search Report dated Nov. 12, 2020, issued for European Patent Application No. 18763484.5.

* cited by examiner

CORROSION-RESISTANT TERMINAL MATERIAL, CORROSION-RESISTANT TERMINAL, AND WIRE-END STRUCTURE

Priority is claimed on Japanese Patent Application Nos. 2017-42713 and 2017-42714, filed Mar. 7, 2017, the content of which is incorporated herein by reference.

BACKGROUND OF THE INVENTION

Technical Field

The present invention is used for a terminal crimped to an end of an electric wire formed from an aluminum wire material, and relates to a corrosion-resistant terminal material in which galvanic corrosion does not arise easily, a corrosion-resistant terminal formed from the terminal material, and a wire-end structure using the terminal.

Background Art

Conventionally, a terminal made of copper or a copper alloy is crimped to an end of an electric wire made of copper or a copper alloy and this terminal is connected to a terminal provided with equipment, so that the electric wire is connected to the equipment. In order to reduce a weight of the electric wire and so forth, there is a case in which a core wire of the electric wire is made of aluminum or an aluminum alloy instead of copper or a copper alloy.

For example, Patent Document 1 discloses an aluminum electric wire made of aluminum alloy for a wire harness in an automobile.

In a case in which the electric wire (a conductive wire) is formed from aluminum or an aluminum alloy and the terminal is formed from copper or a copper alloy, galvanic corrosion may arise owing to a potential difference between different metals when water moves into a crimping part between the terminal and the electric wire. Due to this corrosion of the electric wire, an electric resistance value may be increased and a crimping force may be decreased in the crimping part.

For example, Patent Document 2 and Patent Document 3 describe prevention methods of this corrosion.

Patent Document 2 discloses a terminal provided with a ground metal part formed from a first metal material, an intermediate layer formed from a second metal material having a smaller value of a standard electrode potential than that of the first metal material and provided thinly on at least a part of a surface of the ground metal part by plating, and a surface layer formed from a third metal material having a smaller value of a standard electrode potential than that of the second metal material and provided thinly on at least a part of a surface of the intermediate layer by plating. The first metal material is disclosed as copper or an alloy thereof; the second metal material is disclosed as lead or an alloy thereof, tin or an alloy thereof, nickel or an alloy thereof, and zinc or an alloy thereof; and the third metal material is disclosed as aluminum or an alloy thereof.

Patent Document 3 discloses a termination structure of a wire harness in an end area of a coated electric wire in which a crimping part formed at one end of a terminal metallic member is crimped along an outer circumference of a coating part of the coated electric wire, and at least, a whole of outer circumference of an end exposed area of the crimping part and a vicinity area thereof is fully coated with a mold resin.

CITATION LIST

Patent Literature

Patent Document 1: Japanese Unexamined Patent Application, First Publication No. 2004-134212

Patent Document 2: Japanese Unexamined Patent Application, First Publication No. 2013-33656

Patent Document 3: Japanese Unexamined Patent Application, First Publication No. 2011-222243

SUMMARY OF INVENTION

Technical Problem

However, even though the corrosion can be prevented by the structure described in Patent Document 3, there are problems in that a manufacturing cost is increased by an additional resin molding step, and furthermore, the wire harness is prevented from reducing in size because a sectional area of the terminal is increased owing to the resin. There was a problem in that it takes an extremely high cost because ionic liquid and the like are used in order to perform an aluminum-based plating that is the third metal material described in Patent Document 2.

The present invention is achieved in consideration of the above circumstances, and has an object to provide a corrosion-resistant terminal material using a copper or copper alloy substrate to prevent galvanic corrosion, a corrosion-resistant terminal, and a wire-end structure using this terminal, for a terminal that is crimped to an end of the electric wire having an aluminum core wire.

Solution to Problem

A corrosion-resistant terminal material of the present invention is provided with a substrate made of copper or a copper alloy and a film layered on the substrate; the corrosion-resistant terminal material in which a planned core wire contact part which is in contact with a core wire of an electric wire when the material is formed as a terminal and a planned contact part to be a contact part are formed; the film formed in the planned core wire contact part has a tin layer made of tin or a tin alloy and a metallic zinc layer formed on the tin layer; and the film formed in the planned contact part has a tin layer made of tin or a tin alloy but does not have the metallic zinc layer.

In this corrosion-resistant terminal material, the metallic zinc layer is formed in the planned core wire contact part: galvanic corrosion when being in contact with the core wire made of aluminum can be prevented because a corrosion potential of the metallic zinc is near to that of aluminum.

On the other hand, if the metallic zinc layer exists on the surface of the tin layer in the planned contact part, the connection reliability may be deteriorated under the high temperature high humidity environment. Therefore, by the structure in which only the planned contact part has no metallic zinc layer thereon, so that it is possible to prevent the contact resistance from increasing even when it is exposed in the high temperature high humidity environment.

In addition, the tin layer in the planned core wire contact part and the tin layer in the planned contact part are the layers having the same composition, or the layers having different compositions.

As a preferred aspect of the corrosion-resistant terminal material of the present invention, it is preferable that the tin layer in the planned core wire contact part be formed on a zinc-nickel alloy layer containing zinc and nickel.

There is the zinc-nickel alloy layer under the tin layer, so that the zinc is diffused to a surface of the tin layer, so the metallic zinc layer is maintained with high density. Even if a whole or a part of the metallic zinc layer and the tin layer is disappeared by abrasion and the like, the galvanic corrosion can be prevented by the zinc-nickel alloy layer thereunder.

On the other hand, in the planned contact part, in order to reduce the deterioration of the connection reliability owing to the diffusion of the zinc, the zinc-nickel alloy layer does not exist under the tin layer.

As a preferred aspect of the corrosion-resistant terminal material of the present invention, it is preferable that the zinc-nickel alloy layer have a nickel content percentage not less than 5% by mass and not more than 35% by mass.

If the nickel content percentage in the zinc-nickel alloy is less than 5% by mass, a substitution reaction occurs while tin plating for forming the tin layer, and adhesion property of the tin plating may be deteriorated. If it exceeds 35% by mass, an effect of lowering the corrosion potential at the surface is poor.

In a preferred aspect of the corrosion-resistant terminal material of the present invention, it is preferable that the metallic zinc layer have a coating rate not less than 30% and not more than 80% to a surface after being formed as the terminal.

The metallic zinc layer must not exist in the planned contact part, but is necessary to exist in the planned core wire contact part. It is not necessary that it necessarily exist in the other parts: but it is desirable that a rate of the parts where the metallic zinc layer exists is higher: it is preferable that it exist with the coating rate not less than 30% and not more than 80% to the whole surface when it is formed as a terminal.

In a preferred aspect of the corrosion-resistant terminal material of the present invention, it is preferable that the metallic zinc layer have a zinc density not less than 5 at % and not more than 40 at %, and a thickness in terms of $SiO_2$ not less than 1 nm and not more than 10 nm.

If the zinc density in the metallic zinc layer is less than 5 at %, the effect of lowering the corrosion potential is poor: if it exceeds 40 at %, the connection resistance may be deteriorated. If the thickness of the metallic zinc layer in terms of $SiO_2$ is less than 1 nm, the effect of lowering the corrosion potential is poor: if it exceeds 10 nm, the connection resistance may be deteriorated.

In a preferred aspect of the corrosion-resistant terminal material of the present invention, it is preferable that the tin layer in the planned core wire contact part be made of a tin alloy containing zinc not less than 0.4% by mass and not more than 15% by mass.

If the tin layer contains zinc, there is the effect of preventing the corrosion of the aluminum core wire by lowering the corrosion potential, and furthermore, the anti-corrosion effect is maintained of a long time because zinc can be supplied to the metallic zinc layer on the surface of the tin layer. If the zinc density is less than 0.4% by mass, the anti-corrosion effect is poor: if it exceeds 15% by mass, corrosion durability on the tin layer is deteriorated, and the contact resistance may be deteriorated because the tin layer is corroded when exposed in the corrosion environment.

In a preferred aspect of the corrosion-resistant terminal material of the present invention, it is preferable that a surface of the substrate be covered with a ground layer made of nickel or a nickel alloy.

The ground layer on the surface of the substrate has an effect of preventing the contact resistance from increasing owing to the diffusion of the copper from the substrate to the surface of the film when a heat load is added.

In a preferred aspect of the corrosion-resistant terminal material of the present invention, it is formed in a belt sheet shape, and to a carrier along a longitudinal direction thereof, terminal members having the planned core wire contact part and the planned contact part are coupled, with intervals along a longitudinal direction of the carrier.

A corrosion-resistant terminal of the present invention is a terminal formed from the above described corrosion-resistant terminal material: in a wire-end structure of the present invention, the corrosion-resistant terminal is crimped to an end of an electric wire made of aluminum or an aluminum alloy.

Advantageous Effects of Invention

According to the present invention, the galvanic corrosion can be prevented when the planned core wire contact part is in contact with the aluminum core wire, because the metallic zinc layer having the corrosion potential near to that of aluminum is formed on the surface in the planned core wire contact part. On the other hand, in the planned contact part, it is possible to prevent the increase of the contact resistance even when the planned contact part is exposed in the high temperature high humidity environment, because the metallic zinc layer is not formed.

DESCRIPTION OF EMBODIMENTS

A corrosion-resistant terminal material, a corrosion-resistant terminal and a wire-end structure according to embodiments of the present invention will be explained.

First Embodiment

Figure 2:
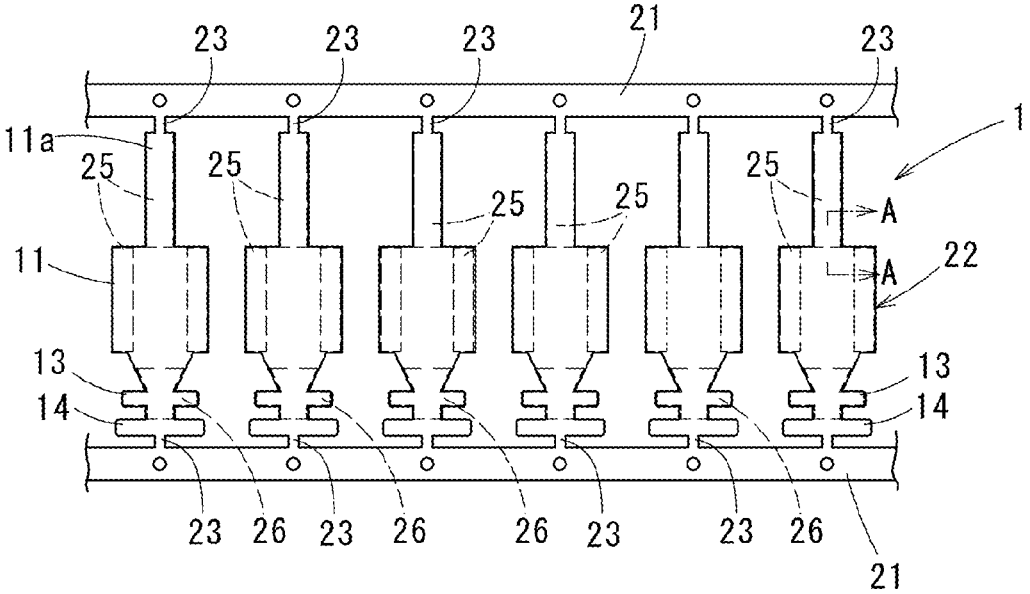
FIG. 2 It is a plan view of the corrosion-resistant terminal material of the first embodiment.

A corrosion-resistant terminal material 1 of a first embodiment is, as a whole is shown in FIG. 2, a strip material formed to have a belt sheet shape to form terminals: carriers 21 are formed on both sides of the strip material along a length direction; between the carriers 21, terminal members 22 formed to be terminals are arranged with intervals along a length direction of the carriers 21; the respective terminal members 22 are coupled to the carriers 21 with coupling parts 23 with a narrow width therebetween. The terminal members 22 are respectively formed in a terminal shape shown in FIG. 3 for example, and finished as corrosion-resistant terminals 10 by cutting off from the coupling parts 23.

Figure 3:
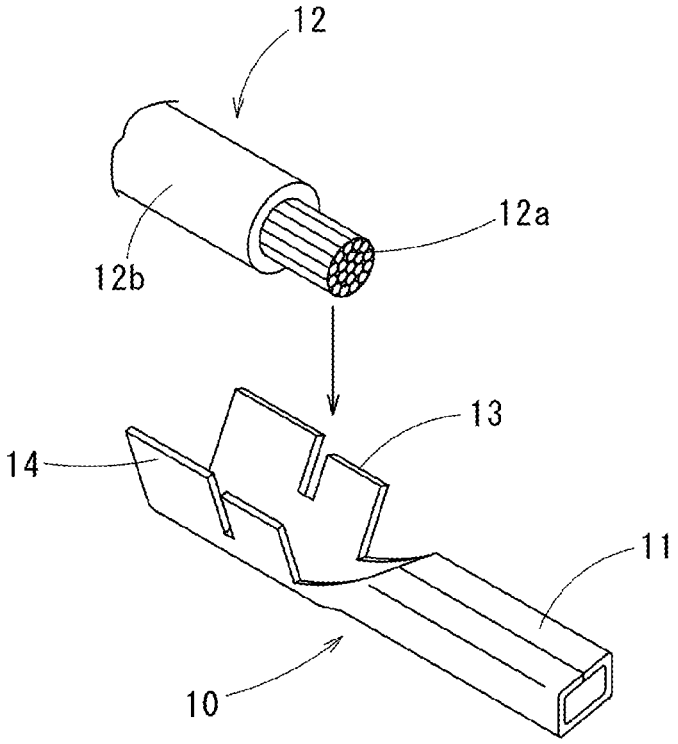
FIG. 3 It is a perspective view showing an example of a terminal to which the corrosion-resistant terminal material of the first embodiment is applied.

The corrosion-resistant terminals 10, shown in FIG. 3 as a female terminal, are formed with a connection part 11 to which a male terminal 15 (refer to FIG. 4) is crimped, a core wire-crimping part 13 to which an exposed core wire 12*a* of an electric wire 12 is crimped, and a coat crimping part 14 to which a coating part 12*b* of the electric wire 12 is crimped, integrally in this order from a distal end thereof. The connection part 11 is formed in a square tube shape: a spring piece 11*a* connected to a distal end of the square tube is folded and inserted in the square tube (refer to FIG. 4).

Figure 4:
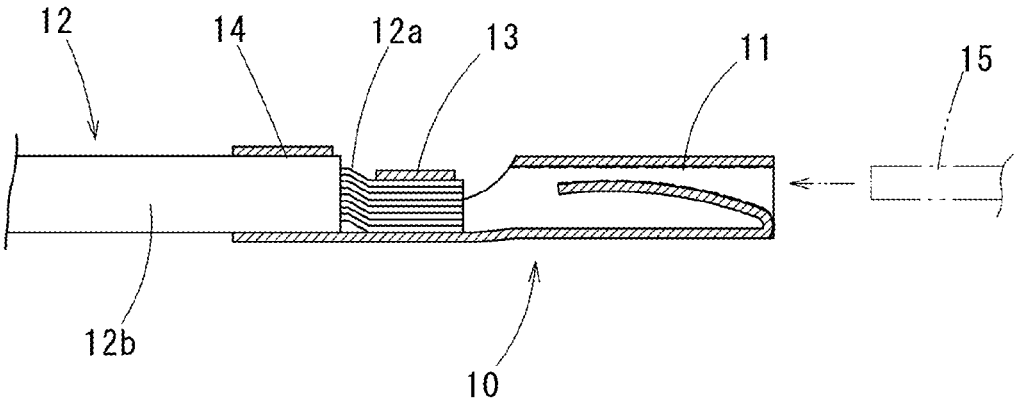
FIG. 4 It is a frontal view showing an end of an electric wire to which the terminal in FIG. 3 is crimped.

FIG. 4 shows a wire-termination structure in which a corrosion-resistant terminal 10 is crimped to the electric wire 12: a vicinity of the core wire-crimping part 13 is in directly contact with the core wire 12*a* of the electric wire 12.

In the above-mentioned strip material, in a part to be the connection part 11 when it is formed as the corrosion-resistant terminal 10, a part to be a contact by being in contact with the male terminal 15 is a planned contact part 25, and a surface of a part being in contact with the core wire 12*a* in a vicinity of the core wire-crimping part 13 is a planned core wire contact part 26.

In this case, the planned contact part 25 is, in the female terminal of the embodiment, formed on an inner surface of the connection part 11 formed in the square tube shape and a surface of the spring piece 11*a* which is folded in the connection part 11 and opposed to the inner surface of the connection part 11. In a state in which the connection part 11 is unfolded, surfaces of both sides of the connection part 11 and a back surface of the spring piece 11*a* are the planned contact part 25.

Figure 1:
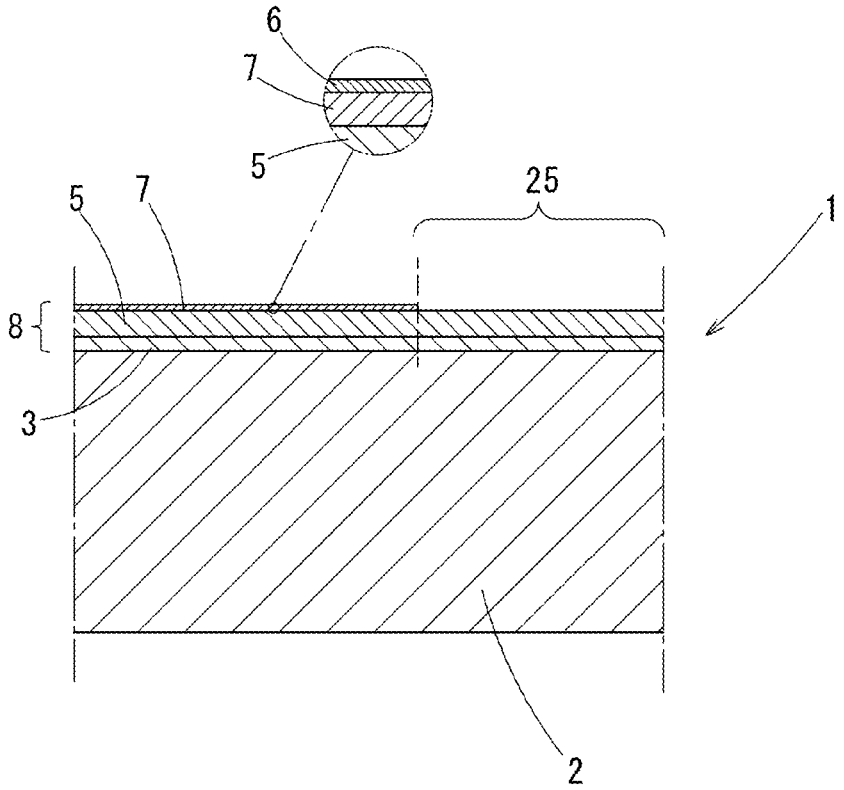
FIG. 1 It is a sectional view schematically showing a first embodiment of a corrosion-resistant terminal material of the present invention.

In the corrosion-resistant terminal material 1, as FIG. 1 schematically shows a section (corresponding to a section along the line A-A in FIG. 2), a film 8 is formed on a substrate 2 made of copper or a copper alloy: in the film 8, on a surface of a part other than the planned contact part 25, a ground layer 3 made of nickel or a nickel alloy and a tin layer 5 are layered in this order; and a metallic zinc layer 7 is formed on the tin layer 5 and under an oxide layer 6 formed on an outermost surface thereof. On the other hand, in the planned contact part 25, the ground layer 3 and the tin layer 5 are layered in this order, there is not the metallic zinc layer 7 though. It is desirable that the metallic zinc layer 7 exist with a coating rate not less than 30% and not more than 80% of a surface (a surface of the terminal member 22) after being formed as the terminal 10.

Composition of the substrate 2 is not specifically limited if it is made of copper or a copper alloy.

Below, regarding the film 8, at first, a part (including the planned core wire contact part 26) except for the planned contact part 25 will be explained by every layers.

The ground layer 3 has a thickness not less than 0.1 μm and not more than 5.0 μm and a nickel content percentage is not less than 80% by mass. The ground layer 3 has a function of preventing diffusion of copper from the substrate 2 to the tin layer 5: if the thickness is less than 0.1 μm, an effect of preventing the diffusion of copper is poor; if it exceeds 5.0 μm, breakages easily occur while press working. More preferably, the thickness of the ground layer 3 is not less than 0.3 μm and not more than 2.0 μm.

If the nickel content percentage is less than 80% by mass, the effect of preventing diffusion of copper to the tin layer 5 is small. It is more preferable that the nickel content percentage be not less than 90% by mass.

The tin layer 5 has a zinc density not less than 0.4% by mass and not more than 15% by mass. If the zinc density in the tin layer 5 is less than 0.4% by mass, an effect of preventing corrosion of an aluminum wire by lowering corrosion potential is poor; if it exceeds 15% by mass, corrosion durability of the tin layer 5 is remarkably deteriorated, so that the tin layer 5 is corroded in corrosion environment and contact resistance may be deteriorated. More preferably, the zinc density in the tin layer 5 is not less than 0.6% by mass and no more than 2.0% by mass It is preferable that a thickness of the tin layer 5 be not less than 0.1 μm and not more than 10 μm: if it is too thin, solder wettability and the contact resistance may be deteriorated: if it is too thick, coefficient of dynamic friction at a surface is increased and mounting/dismounting resistance is tend to be increased when it is used for a connector or the like.

The metallic zinc layer 7 has a zinc density not less than 5 at % and not more than 40 at % and a thickness not less than 1 nm and not more than 10 nm in terms of $SiO_2$. If the zinc density in the metallic zinc layer is less than 5 at %, there is no effect of lowering corrosion potential: if it exceeds 40 at %, the contact resistance is deteriorated. It is more preferable that the zinc density in the metallic zinc layer 7 be not less than 10 at % and not more than 25 at %.

If the thickness of the metallic zinc layer 7 is less than 1 nm in terms of $SiO_2$, the effect of lowering the corrosion potential is poor; if it exceeds 10 nm, the contact resistance may be deteriorated. The thickness in terms of $SiO_2$ is more preferably not less than 1.25 nm and not more than 3 nm.

On the surface of the metallic zinc layer 7, the oxide layer 6 of zinc and tin is formed.

Exists on a surface of the part except for the planned contact part 25 is the film 8 having the above-described layer structure, as described above. On the other hand, in the planned contact part 25, only the ground layer 3 made of nickel or a nickel alloy and the tin layer 5 exist. Respective compositions and the film thicknesses and the like of the ground layer 3 and the tin layer 5 are the same as those forming the film 8 existing on the surface of the part except for the planned contact part 25.

Next, a method of manufacturing the corrosion-resistant terminal material 1 will be explained.

As the substrate 2, a sheet material made of copper or a copper alloy is prepared. Works of cutting, punching and the like are performed on the sheet material, as shown in FIG. 2, so that the strip material is formed in which the terminal members 22 are coupled to the carrier 21 with the coupling parts 23 therebetween. Then, a surface of this strip material is cleaned by treatments of degreasing, pickling and the like, and a nickel or nickel alloy plating are performed for forming the ground layer 3 on a whole surface thereof; then, the planned contact parts 25 are covered with a mask (not illustrated), and a tin-zinc alloy plating is performed: then the mask is removed, a tin or tin alloy plating is performed on the whole surface for forming the tin layer 5.

The nickel or nickel alloy plating for forming the ground layer 3 is not specifically limited if a dense film with mainly containing nickel can be obtained: it can be formed by electroplating using a known Watts bath, a sulfamic acid bath, a citric acid bath or the like. For nickel alloy plating, a nickel tungsten (Ni—W) alloy, a nickel phosphorous (N—P) alloy, a nickel cobalt (Ni—Co) alloy, a nickel chromium (Ni—Cr) alloy, a nickel iron (Ni—Fe) alloy, a nickel boron (Ni—B) alloy and the like can be used.

Considering the corrosion-resistant terminal 10 in a press bending property and a barrier property against copper, a pure nickel plating obtained by the sulfamic acid bath is appropriate.

Tin or tin alloy plating for forming the tin layer 5 can be performed by known methods: i.e., electroplating can be performed with an organic acid bath (i.e., a phenol sulfonic acid bath, an alkane sulfonic acid bath, or an alkanol sulfonic acid bath), an acidic bath such as a fluoroboric acid bath, a halogen bath, a sulfuric acid bath, a pyrophosphoric acid bath and the like, or an alkaline bath such as a potassium bath, a sodium bath or the like.

A method for alloying the tin layer 5 with zinc is as follows: a zinc alloy layer containing zinc, such as a tin-zinc alloy layer, is formed between a tin layer and a substrate made of copper or a copper alloy, and zinc is diffused from this zinc alloy layer to the tin layer, so that the tin layer is alloyed. Specifically, as described above, in a state in which the planned contact parts 25 are covered with the mask, tin-zinc alloy plating is performed on surfaces of parts which are not covered with the mask; tin or tin alloy plating is performed on a whole surface including a tin-zinc alloy plating layer after removing the mask.

As described above, after plating is performed on the substrate 2, a heat treatment is performed.

In this heat treatment, it is heated at temperature in which a surface temperature of a material to be not less than 30° C. and not more than 190° C. By this heat treatment, at the other parts than the planned contact parts 25, zinc in the tin-zinc alloy plating layer diffuses into the tin plating layer and on the tin plating layer, and is united as the tin-zinc alloy; and thinly forms a metallic zinc layer on the surface. As zinc is rapidly diffused, the metallic zinc layer 7 can be formed by exposing at temperature 30° C. or higher for 24 hours or longer. However, it is not heated to temperature higher than 190° C. because tin-zinc alloy repels melted tin and forms parts where tin is repelled on the tin layer 5.

In the corrosion-resistant terminal material 1 manufactured as above, the ground layer 3 made of nickel or a nickel alloy is formed on the substrate 2: in the planned contact parts 25 which were covered with the mask, the tin layer 5 is formed on the ground layer 3: in the other parts than the planned contact parts 25, the tin layer 5 and the metallic zinc layer 7 are formed on the ground layer 3: and on a surface of the metallic zinc layer 7, the oxide layer 6 is thinly formed. Zinc is not contained in the tin layer 5 in the planned contact parts 25, or the amount is very few even if it is contained: the tin layer 5 contains zinc in the other parts than the planned contact parts 25.

Then, the shape of the terminal shown in FIG. 3 is formed by a pressing work and the like as it remains the strip material: and the coupling parts 23 are cut, so that the corrosion-resistant terminals 10 are formed.

FIG. 4 shows a termination structure in which the electric wire 12 is crimped on the terminal 10: the core wire crimp part 13 is in directly contact with the core wire 12*a* of the electric wire 12.

In this corrosion-resistant terminal 10, the tin layer 5 contains zinc and the metallic zinc layer 7 is formed under the oxide layer 6 on the outermost surface of the tin layer 5 in the planned core wire contact part 26: since the corrosion potential of the metallic zinc is very near to that of aluminum, the galvanic corrosion can be prevented, even if it is crimped to the aluminum core wire 12*a*. In this case, the substrate 2 is not exposed even at end surfaces of the terminal 10 because the plating treatment and the heat treatment were performed in the state of the strip material of FIG. 2, so it is possible to show an excellent anti-corrosion effect.

If the metallic zinc layer 7 exists on the surface of the tin layer 5, connection reliability may be deteriorated under high temperature and high humidity environment: in this embodiment, since the metallic zinc layer 7 does not exist in the structure of the planned contact parts 25, the contact resistance can be prevented from increasing even when exposed in the high temperature high humidity environment.

In the first embodiment, as a method for not forming the metallic zinc layer 7 in the planned contact parts 25, the tin-zinc alloy plating and the like were performed in the state in which the planned contact parts 25 were covered with the mask: it is possible to apply a method of performing the tin-zinc alloy plating on the whole surface including the planned contact parts 25 and then the tin-zinc alloy plating layer in the planned contact parts 25 is removed by a partial etching.

In the other parts than the planned contact parts 25, the metallic zinc layer 7 on the surface was formed by diffusion from the tin-zinc alloy plating layer: the metallic zinc layer 7 can be formed by zinc plating on the surface of the tin layer 5. The zinc plating can be performed by known methods: for example, electroplating can be performed with a zincate bath, a sulfate bath, a zinc chloride bath, a cyanogen bath. In this case, the tin layer 5 in the planned contact parts 25 and the tin layer 5 in the other parts than the planned contact parts 25 have approximately the same composition.

For an alternative to form the tin-zinc alloy plating layer before the tin or tin alloy plating, it is applicable that the tin layer 5 is formed with individually the tin layer in the planned contact parts 25 and the tin layer on the other parts than the planned contact parts 25; but the tin-zinc alloy plating before the tin or tin alloy plating is not performed. Specifically, the tin-zinc alloy plating is performed so that a zinc density is a prescribed value with a known tin-zinc alloy plating solution, this tin-zinc alloy plating layer is the tin layer as the tin layer in the other parts than the planned contact parts 25. As the tin layer in the planned contact parts 25, for example, pure tin plating is performed for the tin layer. In this case, by performing the above-mentioned heat treatment, zinc in the tin layer in the other parts than the planned contact parts 25 diffuses on the surface of the tin layer, so that the metallic zinc layer 7 is formed.

Second Embodiment

Figure 5:
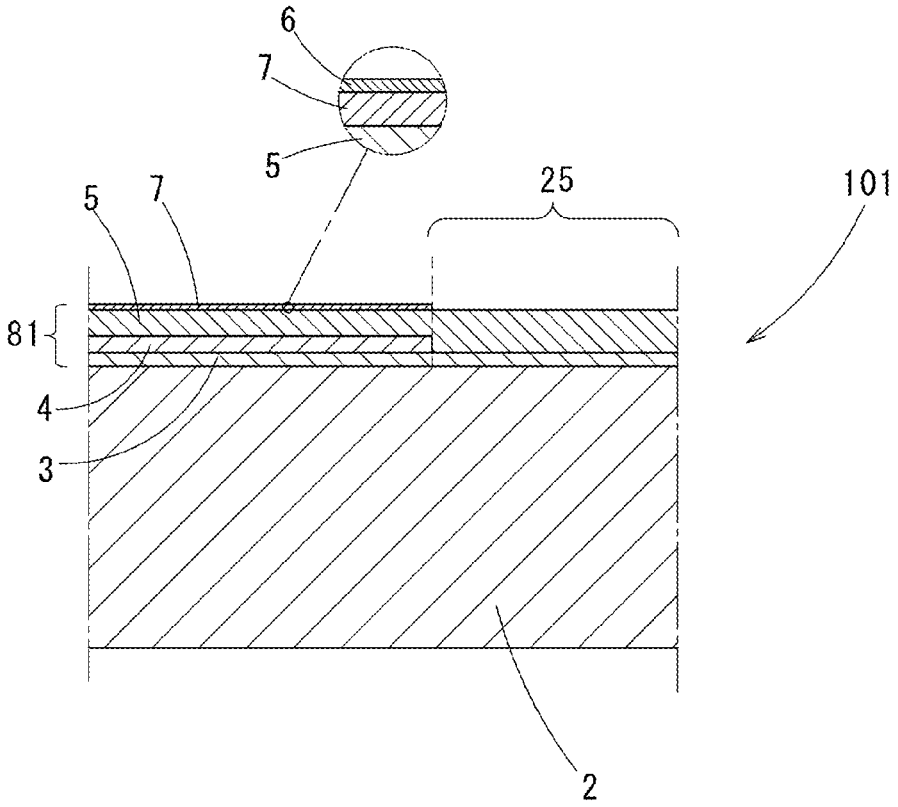
FIG. 5 It is a sectional view schematically showing a second embodiment of the corrosion-resistant terminal material of the present invention.

FIG. 5 schematically shows a sectional view of a corrosion-resistant terminal material 101 of a second embodiment of the present invention.

In the corrosion-resistant terminal material 101, a film 81 is formed on the substrate 2 made of copper or a copper alloy: in the film 81, layered are the ground layer 3 made of nickel or a nickel alloy, a zinc-nickel alloy layer 4, and the tin layer 5 in this order on a surface of parts except for the planned contact parts 25: on the tin layer, under the oxide layer 6 formed on the outermost surface, the metallic zinc layer 7 is formed. On the other hand, the planned contact parts 25 have the ground layer 3 and the tin layer 5 layered in this order, but do not have the zinc-nickel alloy layer 4 and the metallic zinc layer 7.

The composition of the substrate 2, the composition and the thickness of the ground layer 3, the composition and the thickness of the tin layer 5, the composition and the thickness in terms of $SiO_2$ of the metallic zinc layer 7, the composition of the oxide layer 6 and the like are the same as those in the first embodiment; the same reference symbols are assigned and the explanation thereof is abbreviated. As the case of the first embodiment, it is preferably that the metallic zinc layer 7 exist on the surface after the terminals 10 are formed (the surface of the terminal members 22 in FIG. 2) with a coating rate not less than 30% and not more than 80%.

The zinc-nickel alloy layer 4 has a thickness not less than 0.1 μm and not more than 5.0 μm, contains zinc and nickel, and also contains tin since it is adjacent to the tin layer 5. A nickel content percentage in the zinc-nickel alloy layer 4 is not less than 5% by mass and not more than 35% by mass.

If this thickness of the zinc-nickel alloy layer 4 is less than 0.1 μm, an effect of lowering a corrosion potential at a surface is poor: if it exceeds 5.0 μm, breakages may occur while a press working on the terminal 10. The thickness of the zinc-nickel alloy layer 4 is more preferably not less than 0.3 μm and not more than 2.0 μm.

If the nickel content percentage in the zinc-nickel alloy layer 4 is less than 5% by mass, a substitution reaction occurs while under-mentioned tin plating for forming the tin layer 5, so that adhesion property of the tin plating (the tin layer 5) is deteriorated. If the nickel content percentage in the zinc-nickel alloy layer 4 exceeds 35% by mass, an effect of lowering the corrosion potential at the surface is small. It is more preferable that this nickel content percentage be not less than 7% by mass and not more than 20% by mass. The zinc-nickel alloy layer 4 is formed in at least the planned core wire contact parts 26: it is preferable not to exist at the planned contact parts 25 in order to prevent defects of contact points owing to diffusion of zinc from a ground.

The film 81 having an above layer composition exists on the surface of the parts except for the planned contact parts 25 as described above. As described above, it is desirable that the film 81 having the metallic zinc layer 7 exist with the coating rate not less than 30% and not more than 80% on the surface when it is formed as the terminals 10. On the other hand, in the planned contact parts 25, only the ground layer 3 made of nickel or a nickel alloy and the tin layer 5 exist. The respective compositions and the thicknesses of the ground layer 3 and the tin layer 5 are the same as those forming the film 81 existing on the surface of the parts except for the planned contact parts 25.

Also in a method of manufacturing the corrosion-resistant terminal material 101 of the second embodiment, the substrate 2 which is the same as that in the first embodiment is formed into the strip material as shown in FIG. 2, the surface is cleaned, the nickel or nickel alloy plating is performed for forming the ground layer 3 on the whole surface, the planned contact parts 25 is covered with the mask, zinc-nickel alloy plating is performed in this state for forming the zinc-nickel alloy layer 4, the mask is removed, and the tin or tin alloy plating is performed for forming the tin layer 5 on the whole surface.

The plating bath and the plating condition of the nickel or nickel alloy plating for forming the ground layer 3 is the same as those in the first embodiment.

The zinc-nickel alloy plating for forming the zinc-nickel alloy layer 4 is not specifically limited if a dense film can be obtained with a prescribed composition; a sulfate bath, a chloride bath, a neutral bath and the like which are known can be used.

The tin or tin alloy plating for forming the tin layer 5 can be performed by a known method: for example, electroplating can be performed with an organic acid bath (e.g., a phenol sulfonic acid bath, an alkane sulfonic acid bath, or an alkanol sulfonic acid bath), an acidic bath such as a fluoroboric bath, a halogen bath, a sulphate bath, a pyrophosphoric acid bath, or an alkaline bath such as a potassium bath, a sodium bath.

The heat treatment is performed with the same condition as that in the first embodiment after the plating treatments is performed on the substrate 2, formed is the corrosion-resistant terminal material 101 in which the ground layer 3 made of nickel or a nickel alloy is formed on the substrate 2; the tin layer 5 is formed on the ground layer 3 in the planned contact parts 25 which were covered with the mask; in the other parts than the planned contact parts 25, the zinc-nickel alloy layer 4, the tin layer 5, and the metallic zinc layer 7 are formed on the ground layer 3; and the thin oxide layer 6 is formed on the surface of the metallic zinc layer 7.

As in the first embodiment, by forming into the shape of the terminal shown in FIG. 3 as it remains as the strip material by a press working and the like and the coupling part 23 is cut, so that the corrosion-resistant terminal 10 is formed. This corrosion-resistant terminal 10 is crimped to the electric wire 12 so as to be the termination structure shown in FIG. 4, the vicinity of the core wire-crimping part 13 is directly in contact with the core wire 12*a* of the electric wire 12.

In this corrosion-resistant terminal 10, since the tin layer 5 contains zinc and the metallic zinc layer 7 is formed under the oxide layer 6 at the outermost surface of the tin layer 5 in the planned core wire contact part 26, the galvanic corrosion can be prevented even in a state in which it is crimped to the aluminum core wire 12*a* because the corrosion potential of the metallic zinc is very near to that of aluminum. In this case, the substrate 2 is not exposed even at the end surfaces of the terminal 10 because the heat treatment and the plating were performed in a state of the strip material shown in FIG. 2: so the excellent anti-corrosion effect can be shown.

Moreover, the zinc-nickel alloy layer 4 is formed under the tin layer 5, and the zinc thereof diffuses to the surface part of the tin layer 5: so the metallic zinc layer 7 is prevented from disappearing by abrasion and the like, and the metallic zinc layer 7 can be maintained with high density. Even if the whole or a part of the tin layer 5 is disappeared by abrasion and the like, since the corrosion potential of the zinc-nickel alloy layer 4 thereunder is near to that of aluminum, the galvanic corrosion can be pretended.

On the other hand, if the metallic zinc layer 7 exists on the surface of the tin layer 5, the connection reliability may be deteriorated under the high temperature high humidity environment though; the structure in this embodiment in which the metallic zinc layer 7 does not exist in the planned contact parts 25 can prevent the contact resistance from increasing even when it is exposed to the high temperature high humidity environment.

Also in this second embodiment, for the method without forming the metallic zinc layer 7 in the planned contact parts 25, as another method than the method of performing the zinc-nickel alloy plating and the like in the state in which the planned contact parts 25 are covered with the mask, it is possible to apply the method of performing the zinc-nickel alloy plating on the whole surface including the planned contact parts 25 and the zinc-nickel alloy plating layer in the planned contact parts 25 is removed by the partial etching.

In the other parts than the planned contact parts 25, the metallic zinc layer 7 on the surface was formed by the diffusion from the zinc-nickel alloy layer 4 though, the metallic zinc layer 7 may be formed by a zinc plating on the surface of the tin layer 5. This zinc plating can be performed by a known method though, the electroplating can be performed by using a zincate bath, a sulfate bath, a zinc chloride bath, and a cyanogen bath, for example. In this case, it is preferable that the zinc-nickel alloy layer 4 do not exist in the planned contact parts 25 though, it may exist.

EXAMPLES

Examples of First Embodiment

The strip material shown in FIG. 2 was punched out from a copper sheet of the substrate, and degreased and pickled, and then the tin-zinc alloy plating was performed on except for the planned contact parts 25 in FIG. 2. Furthermore, after that, the tin plating was performed on the whole surface, and the zinc was diffused from the tin-zinc alloy plating layer to the surface by the heat treatment at temperature 30° C. to 190° C. for 1 hour to 36 hours, the metallic zinc layer 7 was formed: the corrosion-resistant terminal material 1 having the metallic zinc layer 7 on the parts except for the planned contact parts 25 was obtained.

As comparative examples, manufactured were a test piece 11 and a test piece 12: in the test piece 11, the metallic zinc layer 7 was formed also in the planned contact parts 25 by performing the tin-zinc alloy plating on the whole surface without covering the planned contact parts 25 with the mask; and in a test piece 12, the tin-zinc alloy plating was not performed also on the other parts than the planned contact parts 25, degreasing and pickling were performed on the copper sheet, and the nickel plating and the tin plating were performed in this order.

Conditions of the respective plating treatments were as follows: the zinc content percentage in the tin-zinc alloy plating was controlled by varying a proportion of tin (II) sulfate and zinc sulfate heptahydrate. The following plating condition of tin-zinc alloy is an example of the zinc content percentage being 15% by mass. Nickel plating for the ground layer 3 was not performed on test pieces 1 to 9: the ground layer 3 was formed on a test piece 10 by performing the nickel plating.

—Condition of Nickel Plating—
Composition of Plating Bath
Nickel Sulfamate: 300 g/L
Nickel Chloride: 5 g/L
Boric Acid: 30 g/L
Bath Temperature: 45° C.
Current Density: 5 A/dm$^2$
—Condition of Tin-Zinc Alloy Plating—
Composition of Plating Bath
Tin (II) Sulfate: 40 g/L
Zinc Sulfate Heptahydrate: 5 g/L
Trisodium Citrate: 65 g/L
Nonionic Surfactant: 1 g/L
pH=5.0
Bath Temperature: 25° C.
Current Density: 3 A/dm$^2$
—Condition of Tin Plating—
Composition of Plating Bath
Methanesulfonic Acid Tin: 200 g/L
Methanesulfonic Acid: 100 g/L
Gloss Agent
Bath Temperature: 25° C.
Current Density: 5 A/dm$^2$ Regarding the obtained test pieces, the zinc density in the tin layer 5, the thickness and the zinc density in the metallic zinc layer 7, and the coating rate of the metallic zinc layer 7 were respectively measured. The zinc density in the tin layer 5 was measured at the surface of the test piece with an electron probe micro analyzer EPMA (model No. JXA-8530F) made by JEOL LTD. (formerly called Japan Electron Optics Laboratory Co., LTD), at an acceleration voltage 6.5 V and a beam diameter 30 μm.

Regarding the thickness and the zinc density of the metallic zinc layer 7, with XPS (X-ray Photoelectron Spectroscopy) analyzer: ULVAC PHI model-5600LS made by Ulvac-Phi Incorporated, the respective test pieces were measured by XPS analysis while etching a surface of the test pieces by argon ion.

The analysis condition is as follows.
X-ray Source: Standard Mg Kα 350 W
Pass Energy: 187.85 eV (Survey), 58.70 eV (Narrow)
Measuring Interval: 0.8 eV/step (Survey), 0.125 eV (Narrow)
Take-Off Angle of photoelectron to a sample surface: 45 deg
Analysis Area: about 800 μm diameter Regarding the thickness, by an etching rate of $SiO_2$ antecedently measured by the same equipment, a "film thickness in terms of $SiO_2$" was calculated from the time required for measurement.

The method of calculating the etching rate of $SiO_2$ was as follows: an $SiO_2$ film was etched with a thickness 20 nm at a rectangle area 2.8×3.5 mm by argon ion, and divided by time required for etching 20 nm. An etching rate in the above analyzer is 2.5 nm/min because it took 8 minutes. XPS is excellent in depth discrimination ability as about 0.5 nm though, the etching rate must be calculated by preparing a flat sample with a known film thickness in order to obtain a value of the film thickness itself because the etching time by Ar ion beam is different depending on materials. The above matters are not easy, so that the "film thickness in terms of $SiO_2$" was prescribed with an etching rate calculated by an $SiO_2$ film with a known film thickness and calculated from the time required for etching so as to utilize. Accordingly, it is necessary to pay attention to that the "film thickness in terms of $SiO_2$" differs from an actual film thickness of the oxide. Even though the actual film thickness is uncertain, by prescribing the film thickness with the etching rate in terms of $SiO_2$, the film thickness can be quantitatively evaluated because it is uniquely determined.

The film thickness in terms of $SiO_2$ is a film thickness of a part where a metallic zinc density is a prescribed value or higher: even when the density of the metallic zinc can be measured partially, if the layer is very thin and scattered, there is a case of unable to measure as the film thickness in terms of $SiO_2$.

The measuring results are shown in Table 1.

In Table 1, it is shown that the film thickness in terms of $SiO_2$ of the metallic zinc layer of the test pieces 1 to 3 and 11 were not able to be measured.

TABLE 1

| | Planned Contact Part | Planned Core Wire Contact Part | | | | |
|---|---|---|---|---|---|---|
| | | Metallic Zinc Layer | | | Tin Layer | Ground |
| No. | Metallic Zinc Layer Existence | Zinc Density (at %) | Film Thickness (nm) in terms of SiO2 | Coating Rate (%) | Zinc Density (% by mass) | Layer Existence |
| 1 | NO | 50 | — | 20 | 30 | NO |
| 2 | NO | 3 | — | 90 | 0.1 | NO |
| 3 | NO | 50 | — | 30 | 0.2 | NO |
| 4 | NO | 3 | 15 | 80 | 25 | NO |
| 5 | NO | 5 | 1 | 70 | 17 | NO |
| 6 | NO | 40 | 10 | 70 | 0.2 | NO |
| 7 | NO | 15 | 5 | 60 | 0.4 | NO |
| 8 | NO | 35 | 4 | 40 | 15 | NO |
| 9 | NO | 22 | 5 | 60 | 0.8 | NO |
| 10 | NO | 15 | 8 | 50 | 7 | YES |
| 11 | YES | 50 | — | 20 | 30 | NO |
| 12 | NO | 0 | — | | 0 | NO |

The obtained test pieces were formed into 090 type terminals, and crimped to pure aluminum wires. The terminals crimped to the pure aluminum wires were left in corrosion environment, high temperature high humidity environment and high heated environment; and then measured was the contact resistance between the aluminum wires and the terminals, or the contact resistance between the terminals when the terminals were fit inserted to each other.

—Test of Left in Corrosion Environment—

The 090 type female terminal to which the pure aluminum wire was crimped was soaked in a sodium chloride aqueous solution of 5% at 23° C. for 24 hours, and then left under the high temperature and high humidity of 85° C. and 85% RH for 24 hours. After that, the contact resistance between the aluminum wire and the terminal was measured by four-terminal sensing. A current value was 10 mA.

—Test in High Temperature High Humidity Environment—

The 090 type female terminal to which the pure aluminum wire was crimped was left at 85° C., 85% RH for 96 hours. After that, the contact resistance between the aluminum wire and the terminal was measured by the four-terminal sensing. The current value was 10 mA.

—Test of Left in High Heat Environment—

The terminal to which the pure aluminum wire was crimped was left at 150° C. for 500 hours. After that, a 090 type male terminal on which the tin plating was performed was fit inserted thereto, and the contact resistance between the terminals was measured by the four-terminal sensing.

These results are shown in Table 2.

TABLE 2

| No. | Left in Corrosion Environment (mΩ) | Left in High Temperature High Humidity (mΩ) | Left in High Heat (mΩ) |
|---|---|---|---|
| 1 | 6.9 | 4.9 | 2.3 |
| 2 | 7.8 | 2.3 | 3.0 |
| 3 | 4.9 | 1.5 | 2.5 |
| 4 | 3.5 | 2.1 | 4.0 |
| 5 | 4.1 | 0.9 | 3.9 |
| 6 | 2.3 | 1.1 | 2.9 |
| 7 | 2.9 | 2.5 | 2.5 |
| 8 | 1.1 | 0.8 | 1.8 |

TABLE 2-continued

| No. | Left in Corrosion Environment (mΩ) | Left in High Temperature High Humidity (mΩ) | Left in High Heat (mΩ) |
|---|---|---|---|
| 9 | 0.9 | 0.9 | 1.9 |
| 10 | 0.8 | 1.0 | 0.7 |
| 11 | 1.5 | 15 | 9 |
| 12 | 2000 or more | 3.5 | 12 |

Figure 6:
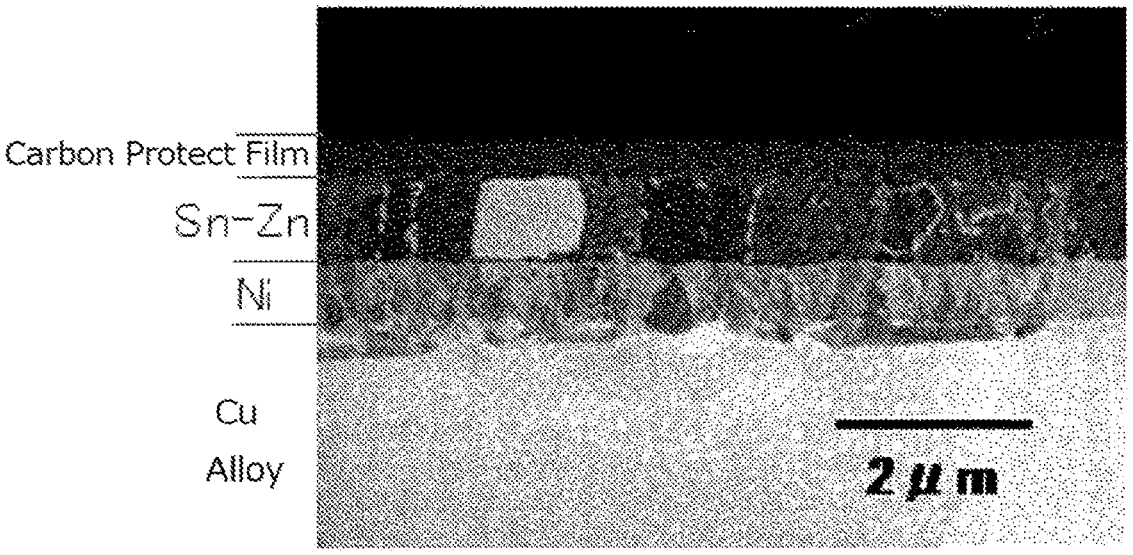
FIG. 6 It is a micrograph of a section of a terminal material of a test piece 7.
Figure 7:
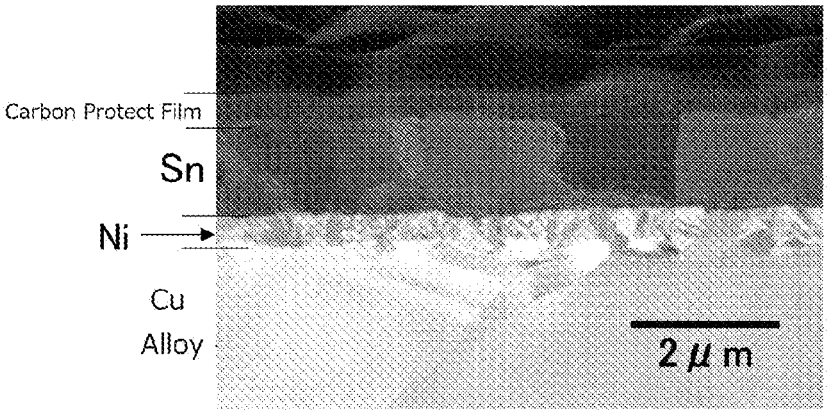
FIG. 7 It is a micrograph of a section of a terminal material of a test piece 12.

FIG. 6 is an electron micrograph of a section at the planned core wire contact part regarding the test piece 10 and enables to recognize that the ground layer (a nickel layer) and the tin-zinc alloy layer are formed from the substrate side. The white parts in the tin layer are zinc enriched parts: the outermost surface part of the tin layer cannot be discriminated. On the other hand, FIG. 7 is an electron micrograph of a section at the planned core wire contact part regarding the test piece 12: the tin layer does not have zinc.

Figure 8:
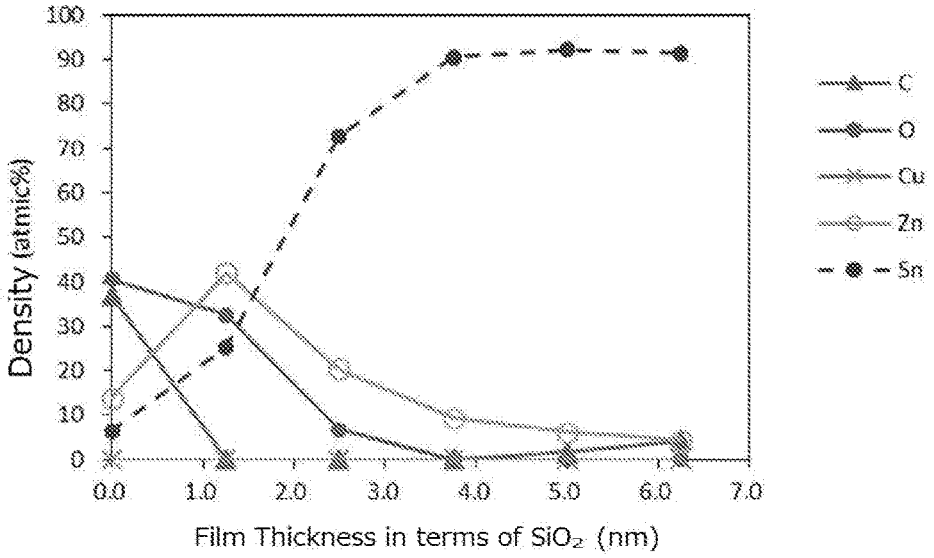
FIG. 8 It is a distribution diagram of density of elements in a depth direction by an XPS analysis in a surface part of a terminal material of a test piece 6.

FIG. 8 is a distribution diagram of density of the elements in a depth direction at a surface part by the XPS analysis at the planned core wire contact part regarding the test piece 9: the metallic zinc layer with the zinc density 5 at % to 43 at % exists 5.0 nm with a thickness in terms of $SiO_2$ in which the zinc density is 22 at %. The zinc density of the metallic zinc layer was a mean value of the zinc density in a thickness direction at a part in which the metallic zinc of 5 at % or more was detected by XPS. The zinc density of the metallic zinc layer in the present invention is a mean value of the zinc density in the thickness direction at the part in which the metallic zinc of 5 at % or more is detected by the XPS analysis.

Figure 9:
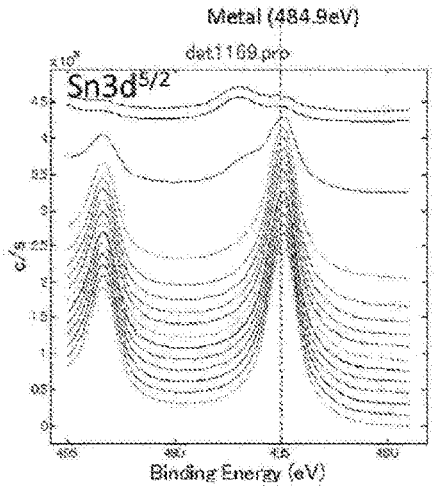
FIG. 9(*a*) and FIG. 9(*b*) It is an analysis diagram of a chemical state in a depth direction in a terminal material of the test piece 7: the part FIG. 9 (*a*) is an analysis diagram of tin and the part FIG. 9 (*b*) is an analysis diagram of zinc.
Figure 9:
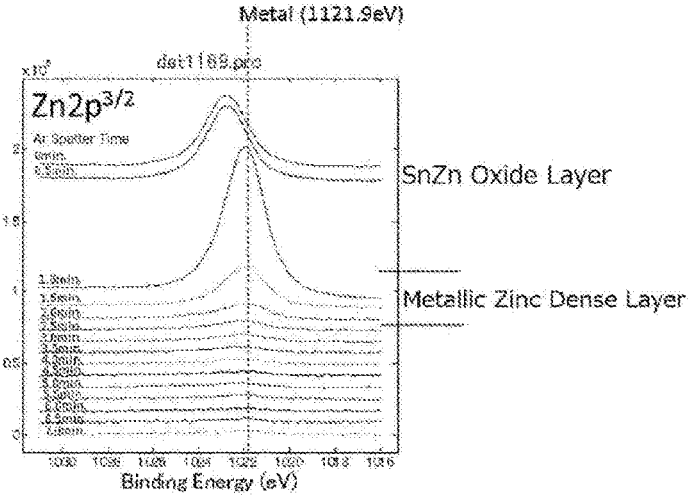

FIG. 9(*a*) and FIG. 9(*b*) is an analysis diagram of a chemical state in the depth direction at the planned core wire contact part of the test piece 7. It is possible to determine from a chemical shift of a binding energy that an oxide is a main constituent in a depth from an outermost surface to 1.25 nm, and a metallic zinc is a main constituent in 2.5 nm or deeper.

From these results, it can be recognized that the parts being in contact with the aluminum core wire have the excellent corrosion resistance because the metallic zinc layer is formed on the surface. Among them, the test pieces 4 to 10 in which the zinc density in the metallic zinc layer was 5 at % to 40 at % (inclusive) and the thickness in terms of $SiO_2$ was 1 nm to 10 nm (inclusive) were lower than the test pieces 1 to 3 in the contact resistance thereof after the test of left in the corrosion environment. Especially, the test piece 10 having the nickel ground layer between the substrate and the zinc-nickel alloy layer has the most excellent corrosion resistance among the test pieces 1 to 10.

On the other hand, in the test piece 11 of a comparative example, the contact resistance was increased by the tests of left in high temperature high humidity and left in high heat because the contact part had the metallic zinc layer. Moreover, in the test piece 12, since there was no metallic zinc layer in the planned core wire contact part, severe corrosion occurred by the test of left in the corrosion environment, and the contact resistant was remarkably increased.

Figure 10:
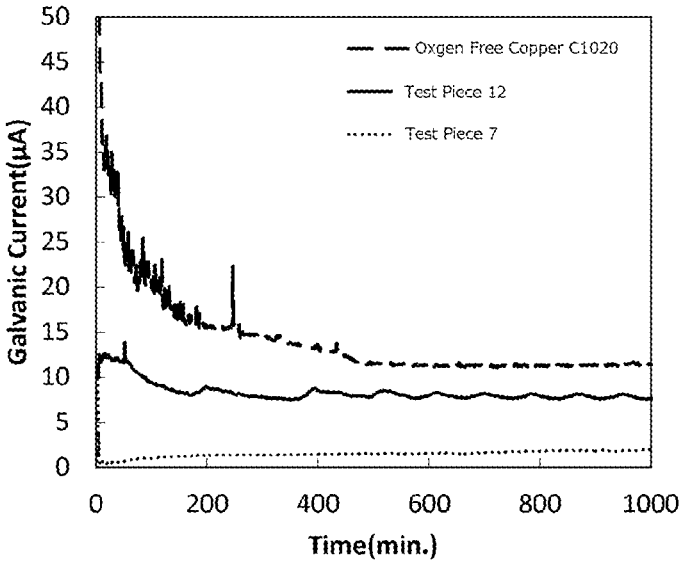
FIG. 10 It is a graph measuring progresses of galvanic corrosion in the terminal material of the test piece 7, the terminal material of the test piece 12, and a copper terminal material without plating.

FIG. 10 shows a measurement result of corrosion current in the planned core wire contact part of the test pieces 10 and 12. For reference, a value regarding a terminal material of oxygen free copper (C1020) without plating is also shown. If the corrosion current is positive and large, the aluminum wire is suffered from the galvanic corrosion: as shown in FIG. 10, it is found that in the test piece 7 of the example the corrosion current is small and the galvanic corrosion can be prevented.

Examples of Second Embodiment

The copper sheet of the substrate was punched out into the strip material shown in FIG. 2, and degreased and pickled; then the zinc-nickel alloy plating was performed on except for the planned contact parts 25 in FIG. 2. Furthermore, after that, the tin plating was performed on the whole surface, and the zinc was diffused from the ground to the surface by the heat treatment at 30° C. to 190° C. for 1 hour to 36 hours, so that the metallic zinc layer 7 was formed: the corrosion resistant terminal material 101 having the metallic zinc layer 7 on the parts except for the planned contact parts 25 was obtained.

As a comparative example, a test piece 31 was manufactured in which the metallic zinc layer 7 was formed also in the planned contact parts 25 by performing the zinc-nickel alloy plating on the whole surface without covering the planned contact parts 25 with the mask. A test piece 32 is the same as the test piece 12 in the example of the first embodiment: the zinc-nickel alloy plating was not performed including the other parts than the planned contact parts 25, the copper sheet was degreased and pickled, and the nickel plating and the tin plating were performed in this order.

Among the plating conditions, the nickel plating condition and the tin plating condition were the same as those in the example of the first embodiment; a condition of the zinc-nickel alloy plating was as below. A nickel content percentage of the zinc-nickel alloy plating was controlled by varying a proportion of nickel sulfate hexahydrate and zinc sulfate heptahydrate. The under-mentioned zinc-nickel alloy plating condition is an example in which the nickel content percentage is 15% by mass. In test pieces 21 to 29, the nickel plating as the ground layer 3 was not performed though: in a test piece 30, the ground layer 3 was formed by performing the nickel plating.

—Condition of Zinc-Nickel Alloy Plating—

Composition of Plating Bath

Zinc Sulfate Heptahydrate: 75 g/L

Nickel Sulfate Hexahydrate: 180 g/L

Sodium Sulfate: 140 g/L pH=2.0

Bath Temperature: 45° C.

Current Density: 5 A/dm$^2$

Regarding the obtained test pieces, the nickel content percentage in the zinc-nickel alloy layer 4, the zinc density in the tin layer 5, the thickness and the zinc density in the metallic zinc layer 7, and the coating rate of the metallic zinc layer 7 were measured respectively.

The measuring methods of the zinc density in the tin layer 5, the thickness and the zinc density in the metallic zinc layer 7, and the coating rate of the metallic zinc layer 7 are the same as those of the examples in the first embodiment.

The nickel content percentage in the zinc-nickel alloy layer 4 was measured as follows: observation samples were formed by thinning samples to 100 nm or less with a focused ion beam device FIB (model No. SMI3050TB) made by Seiko Instrument Inc.; the observation samples were observed with a scanning transmission electron microscope STEM (model No. JEM-2010F) made by JEOL Ltd., at an acceleration voltage 200 kV; and it was measured with an energy dispersive X-ray spectrometer EDS (made by Thermo) belonging to the STEM.

The measurement results are shown in Table 3.

Table 3 shows that it was not possible to measure the film thickness in terms of $SiO_2$ of the metallic zinc layer in the test samples 21 to 23 and 31.

TABLE 3

| | Planned Contact part | Planned Core Wire Contact Part | | | | | |
|---|---|---|---|---|---|---|---|
| | | Metallic Zinc Layer | | | Zinc-Nickel Alloy Layer Nickel Content | Tin Layer | Ground |
| No. | Metallic Zinc Layer Existence | Zinc Density (at %) | Film Thickness (nm) in terms of SiO2 | Coating Rate (%) | Percentage (% by mass) | Zinc Density (% by mass) | Layer Existence |
| 21 | NO | 50 | — | 20 | 4 | 25 | NO |
| 22 | NO | 3 | — | 25 | 5 | 0.1 | NO |
| 23 | NO | 45 | 25 | 85 | 35 | 0.2 | NO |
| 24 | NO | 49 | 15 | 80 | 9 | 20 | NO |
| 25 | NO | 4 | 0.5 | 30 | 30 | 17 | NO |
| 26 | NO | 5 | 1 | 40 | 20 | 0.2 | NO |
| 27 | NO | 40 | 10 | 50 | 25 | 0.2 | NO |
| 28 | NO | 35 | 4 | 60 | 30 | 0.4 | NO |
| 29 | NO | 22 | 5 | 70 | 7 | 15 | NO |
| 30 | NO | 15 | 8 | 70 | 13 | 0.8 | YES |
| 31 | YES | 50 | — | 20 | 4 | 30 | NO |
| 32 | NO | 0 | — | | — | 0 | NO |

The obtained test pieces were formed into the 090 type terminals, and crimped to the pure aluminum wires. The terminals crimped to the pure aluminum wire were left in corrosion environment, high temperature high humidity environment and high heated environment; and then measured was the contact resistance between the aluminum wires and the terminals, or the contact resistance between the terminals when the terminals were fit inserted to each other.

TABLE 4

| No. | Left in Corrosion Environment (mΩ) | Left in High Temperature High Humidity (mΩ) | Left in High Heat (mΩ) |
|---|---|---|---|
| 21 | 5.5 | 4.0 | 2.3 |
| 22 | 3.6 | 3.9 | 2.9 |
| 23 | 2.9 | 1.5 | 2.5 |
| 24 | 3.5 | 1.9 | 4.0 |
| 25 | 3.1 | 1.5 | 3.9 |
| 26 | 1.3 | 2.9 | 2.8 |
| 27 | 1.9 | 2.5 | 2.4 |
| 28 | 1.1 | 2.6 | 2.2 |
| 29 | 0.9 | 0.8 | 2.1 |
| 30 | 0.7 | 1.4 | 0.7 |
| 31 | 1.5 | 21 | 9 |
| 32 | 2000 or more | 3.5 | 12 |

Figure 11:
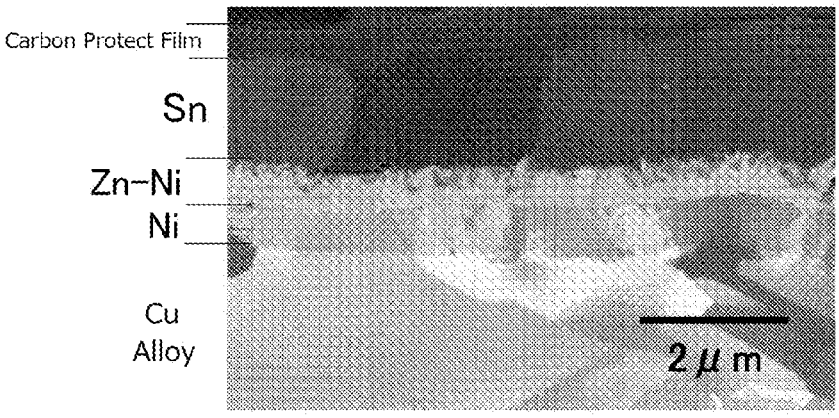
FIG. 11 It is a micrograph of a section of a terminal material of a test piece 30.

FIG. 11 is an electron micrograph of a section at the planned core wire contact part regarding the test piece 30: it can be recognized that the ground layer (the nickel layer), the zinc-nickel alloy layer and the tin layer are formed from the substrate side though; the outermost surface part of the tin layer cannot be discriminated.

Regarding a density distribution of the elements in a depth direction at the surface part by the XPS analysis in the planned core wire contact part, a mean value of the zinc density in the thickness direction in a part in which 5 at % or more of the metallic zinc is detected by the XPS was calculated as the zinc density in the metallic zinc layer, and the mean value of the zinc density in the thickness direction in a part in which 5 at % or more of the metallic zinc is detected by the XPS was obtained as the zinc density in the metallic zinc layer, it has the same tendency as that shown in FIG. 7 of the examples of the first embodiment: the metallic zinc layer with the zinc density 5 at % to 43 at % existed with a thickness 5.0 nm in terms of $SiO_2$; and the zinc density was 22 at %.

Regarding an analysis of a chemical state in the depth direction at the planned core wire contact part, it was possible to determine from a chemical shift of a binding energy that an oxide is a main constituent in a depth from an outermost surface to 1.25 nm, and a metallic zinc is a main constituent in 2.5 nm or deeper, as in the examples of the first embodiment shown in FIG. 8.

From these results, it can be recognized that the parts being in contact with the aluminum core wire have the excellent corrosion resistance by the metallic zinc layer formed on the surface. Among them, the test pieces 24 to 30 in which the zinc density in the metallic zinc layer was 5 at % to 40 at % (inclusive) and the thickness in terms of $SiO_2$ was 1 nm to 10 nm (inclusive) were lower than the test pieces 21 to 23 in the contact resistance after the test of left in the corrosion environment. Especially, the test piece 30 having the nickel ground layer between the substrate and the zinc-nickel alloy layer has the most excellent corrosion resistance among the test pieces 21 to 30.

On the other hand, in the test piece 31 of a comparative example, the contact resistance was increased by the tests of left in high temperature high humidity and left in high heat because the contact part had the metallic zinc layer. Moreover, in the test piece 32, severe corrosion occurred by the test of left in the corrosion environment because there was no metallic zinc layer in the planned core wire contact part, and the contact resistant was remarkably increased.

From results of measuring the corrosion current in the planned core wire contact part, it was found that the aluminum wire was suffered from the galvanic corrosion if the corrosion current was positive and large as in the examples of the first embodiment shown in FIG. 9(*a*) and FIG. 9(*b*): in the test pieces of the examples, the corrosion current was small and the galvanic corrosion was possible to be prevented.

INDUSTRIAL APPLICABILITY

This invention can be used as a terminal for connectors used for connecting electric wires in automobiles, consumer products and the like; especially, it can be used for a terminal crimped to a terminal end of electric wires made of aluminum wire material.

REFERENCE SIGNS LIST

1, 101 Corrosion-resistant terminal material
2 Substrate
3 Ground layer
4 Zinc-nickel alloy layer
5 Tin layer
6 Oxide layer
7 Metallic zinc layer
8, 81 Film
10 Terminal
11 Connection part
12 Electric wire
12*a* Core wire
12*b* Coating part
13 Core wire-crimping part
14 Coat crimping part
25 Planned contact part
26 Planned core wire contact part

The invention claimed is:

1. A corrosion-resistant terminal material comprising a substrate made of copper or a copper alloy and a film layered on the substrate, wherein a planned core wire contact part which is in contact with a core wire of an electric wire when a terminal is formed and a planned contact part to be a contact part are formed;

the film formed in the planned core wire contact part has a tin layer made of tin or a tin alloy and a metallic zinc layer formed on the tin layer; and the film formed in the planned contact part has a tin layer made of tin or a tin alloy but does not have the metallic zinc layer.

2. The corrosion-resistant terminal material according to claim 1, wherein the tin layer in the planned core wire contact part is formed on a zinc-nickel alloy layer containing zinc and nickel.

3. The corrosion-resistant terminal material according to claim 2, wherein the zinc-nickel alloy layer has a nickel content percentage not less than 5% by mass and not more than 35% by mass.

4. The corrosion-resistant terminal material according to claim 1, wherein the metallic zinc layer has a coating rate not less than 30% and not more than 80% to a surface after being formed as the terminal.

5. The corrosion-resistant terminal material according to claim 1, wherein the metallic zinc layer has a zinc density not less than 5 at % and not more than 40 at %, and a thickness in terms of $SiO_2$ not less than 1 nm and not more than 10 nm.

6. The corrosion-resistant terminal material according to claim 1, wherein the tin alloy of which the tin layer in the planned core wire contact part consists contains zinc not less than 0.4% by mass and not more than 15% by mass.

7. The corrosion-resistant terminal material according to claim 1, wherein a surface of the substrate is covered with a ground layer made of nickel or a nickel alloy.

8. The corrosion-resistant terminal material according to claim 1, wherein being formed in a belt sheet shape, and to a carrier along a longitudinal direction thereof, terminal members having the planned core wire contact part and the planned contact part are coupled, with intervals along a longitudinal direction of the carrier.

9. A corrosion-resistant terminal formed from the corrosion-resistant terminal material according to claim 1.

10. A wire-end structure wherein the corrosion-resistant terminal according to claim 9 is crimped to an end of the electric wire made of aluminum or an aluminum alloy.

11. A corrosion-resistant terminal material comprising a substrate made of copper or a copper alloy and a film layered on the substrate, wherein the film comprising a planned core wire contact part which is in contact with a core wire of an electric wire when a terminal is formed and a planned contact part to be a contact part are formed;

the planned core wire contact part consisting of a tin layer made of tin or a tin alloy and a metallic zinc layer formed on the tin layer; and the planned contact part consisting of a tin layer made of tin or a tin alloy but does not have the metallic zinc layer.

12. The corrosion-resistant terminal material according to claim 2, wherein the planned contact part does not exist a zinc-nickel alloy layer containing zinc and nickel under the tin layer.

* * * * *